US006089609A

United States Patent [19]

Denley

[11] Patent Number: 6,089,609

[45] Date of Patent: Jul. 18, 2000

[54] CHECK CLIP

[76] Inventor: Michael E. Denley, 1901 Altivo Dr., Henderson, Nev. 89014

[21] Appl. No.: 08/956,479

[22] Filed: Oct. 23, 1997

[51] Int. Cl.[7] ..... B42D 9/00

[52] U.S. Cl. ..... 281/42; 116/234; 116/236; 248/446; 248/447; 248/451; 281/45; 281/49; 281/51

[58] Field of Search ..... 281/42, 45, 49, 281/51, 40; 116/234, 236, 237; 248/441.1, 446, 447, 451; D19/34

[56] References Cited

U.S. PATENT DOCUMENTS

| | | | |
|---|---|---|---|
| 2,320,383 | 4/1943 | Pepe | 281/42 |
| 2,505,590 | 4/1950 | Steele | 281/42 |
| 2,591,094 | 4/1952 | O'Neill | 281/42 |
| 2,716,390 | 8/1955 | Goins | 281/42 |
| 2,837,802 | 6/1958 | Genco | 281/42 |
| 5,375,885 | 12/1994 | Abercrombie | 281/42 |
| 5,382,054 | 1/1995 | Bettiol | 281/42 |
| 5,427,414 | 6/1995 | Fletcher et al. | 281/42 |
| 5,610,770 | 3/1997 | Galini | 281/42 |
| 5,868,099 | 2/1999 | Begin | 281/42 |

*Primary Examiner*—Andrea L. Pitts
*Assistant Examiner*—Monica Smith Carter
*Attorney, Agent, or Firm*—Patent & Trademark Services; Joseph H. McGlynn

[57] ABSTRACT

A clip that is attached to a checkbook and that will hold the checkbook in an open condition to enable a person to enter information from the checkbook into, for example a computer, without having to hold the checkbook open with one hand. The clip has a first arm that slips onto an open checkbook and a second bar that is parallel with the first bar, with a third bar holding the first and second bars in spaced relation. The second bar has a fourth bar that is perpendicular to the second bar. The fourth bar pivots with respect to the second bar for storage.

6 Claims, 1 Drawing Sheet

CHECK CLIP

BACKGROUND OF THE INVENTION

This invention relates, in general, to clips, and, in particular, to a clip that will hold a check book in an open position.

DESCRIPTION OF THE PRIOR ART

In the prior art various types of clips have been proposed. For example, U.S. Pat. No. 5,375,885 discloses a combination bookmark and page prop having a pair of arms that are pivoted together.

U.S. Pat. No. 5,382,054 discloses a book holder comprising telescoping members which each have a spring biased clip on their ends. The clips attach to the edges of book pages to hold the book open.

U.S. Pat. No. 5,427,414 discloses a device for holding the pages of a book and marking a place in the book comprising an elongated strip of flexible material that is longer than the width of the book and an elastic cord that is connected to the strip and cooperates therewith to hold the book in an open condition.

U.S. Pat. No. 5,610,770 discloses a lens magnification system for booklets that is attached thereto by clips to enable people with poor eyesight to read the booklets.

SUMMARY OF THE INVENTION

The present invention is a clip that is attached to a checkbook and that will hold the checkbook in an open condition to enable a person to enter information from the checkbook into, for example a computer, without having to hold the checkbook open with one hand. The clip has a first arm that slips onto an open checkbook and a second bar that is parallel with the first bar, with a third bar holding said first and second bars in spaced relation. The second bar has a fourth bar that is perpendicular to the second bar. The fourth bar pivots with respect to the second bar for storage.

It is an object of the present invention to provide a new and improved checkbook holder.

It is an object of the present invention to provide a new and improved checkbook holder that will hold a checkbook in an open position.

These and other objects and advantages of the present invention will be fully apparent from the following description, when taken in connection with the annexed drawings.

DESCRIPTION OF THE PREFERRED EMBODIMENT

Figure 1:
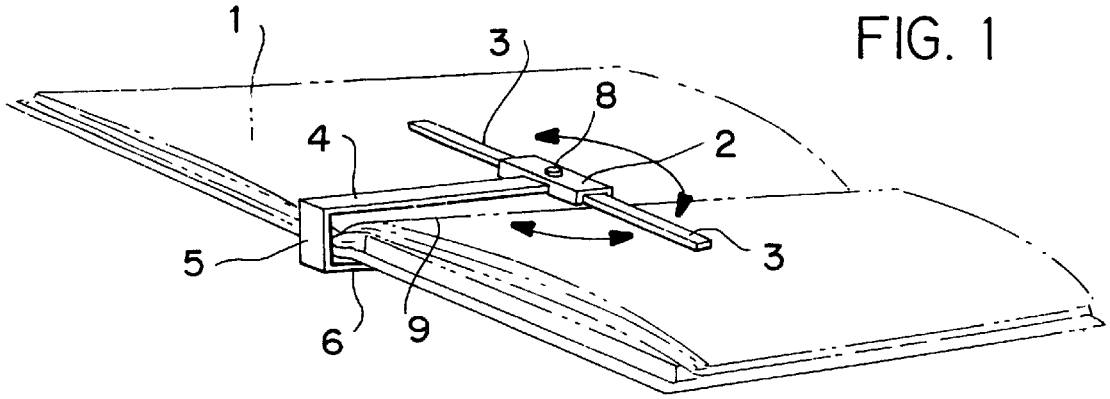
FIG. 1 is a perspective view of the present invention attached to a checkbook.

Referring now to the drawings in greater detail, FIG. 1 shows the present invention attached to a checkbook having pages 1, 1', which are attached together at a spline 9.

Today many people use computer programs to record the information from their checkbooks. The computer program then with a balance and will reconcile the checkbook entries with a bank statement. However, when a user enters the information from the checkbook into the computer, they have to hold the checkbook open with one hand while they type the information into the computer with the other hand. This slows the process since the user can only type with one hand. With the present invention the user can allow the clip to hold the checkbook open while using both hands to type information into the computer.

Figure 2:
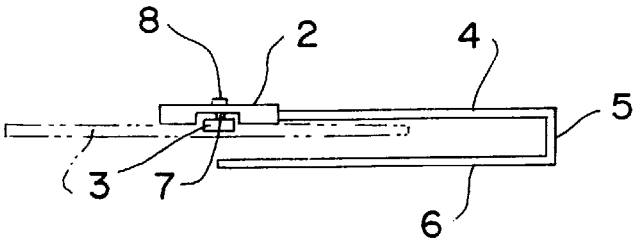
FIG. 2 is a side view of the present invention.

The clip of the present invention is shown in a side view in FIG. 2. The clip has a first arm 6 which will slip beneath the checkbook, or between pages of the checkbook, to secure the clip to the book. A second arm 4, parallel to the first arm, will overlie the checkbook in the area of the spline 9, as shown in FIG. 1. A third arm 5 will secure the first and second arms together. The distance between the arms 4, 6 should be approximately the thickness of the checkbook so it can hold the book open if all of the pages are on the top or bottom half of the checkbook.

Figure 3:
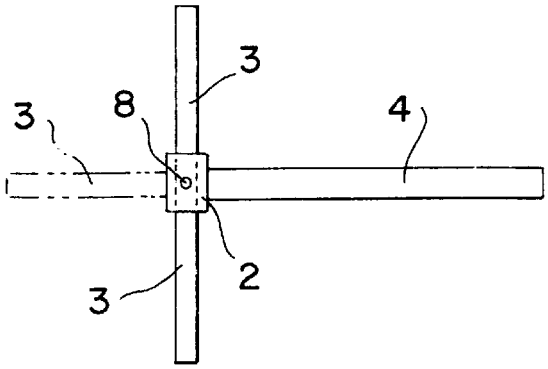
FIG. 3 is a top view of the present invention.

Attached to one end of the arm 4 is a pivot block 2 (see FIGS. 2 and 3). The pivot block 2 can be attached to the arm 4 in any conventional manner including, but not limited to, making the pivot block unitary with the arm 4. Attached to the bottom of the pivot block 2 is a holding arm 3, which should be approximately the same size as the width of the checkbook. When the arm 3 is positioned as shown in FIG. 1, the arm will hold the pages 1, 1' of the checkbook in an open position. This will allow the user to view all the entries in the checkbook without holding the pages open with one hand.

In order to allow the clip to fold, in order to make storage of the clip easier, the arm 3 is attached to the block 2 by any conventional fastener 7 which will allow the arm 3 to pivot about the fastener 7. This will allow the arm to be pivoted into the position shown in FIG. 1 when in use, and to be pivoted to a position where the arm 3 is parallel to the arms 4, 6 when the user is not using the holder (see the dotted line position of the arm 3 in FIG. 3). The fastener which holds the arm 3 pivotally attached to the block 2 can be any conventional fastener such as, but not limited to, a rivet 8.

In addition, the cross-sectional shape of the arms 3, 4, 6 are not essential. Even though they are shown in the drawings as rectangular in cross-section, they could be other shapes such as, but not limited to, circular. Also, even though the present invention has been described as being used with a checkbook, this is merely for illustrational purposes and the clip could be used with any type of book or booklet.

Although the Check Clip and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. A restraining clip to hold books in an open position in combination with a book having a plurality of pages and wherein said book is opened to have at least one left hand page and one right hand page, said clip comprising:

a first arm having a length and a width, a second arm having a length and a width, a third arm joining said first and second arms in parallel relationship, a pivot block connected to one end of said second arm, a fourth arm pivotally connected to said pivot block, said fourth arm being movable from a first position in which said fourth arm is perpendicular to said first and second arms, to a second position where said fourth arm is parallel to said first and second arms, and wherein said book is opened to have at least one left hand page and one right hand page, said first arm is placed beneath said book, and said second arm is placed on top of said opened book, and said fourth arm extends at least partially across said left and right hand page to hold said pages in an open position.

2. The restraining clip as claimed in claim 1, wherein said first, second and third arms form a U-shape.

3. The restraining clip as claimed in claim 1, wherein said fourth arm is pivotally connected to said pivot block by a rivet.

4. A restraining clip to hold books in an open position, said clip comprising:

a first arm having a length and a width, a second arm having a length and a width, a third arm joining said first and second arms in parallel relationship, a pivot block connected to one end of said second arm, a fourth arm pivotally connected to said pivot block, said fourth arm being movable from a first position in which said fourth arm is perpendicular to said first and second arms, to a second position where said fourth arm is parallel to said first and second arms, said fourth arm being in a plane parallel to a plane containing said first and second arms when said fourth arm is in said first position, and said fourth arm being in a plane parallel to a plane containing said first and second arms when said fourth arm is in said second position.

5. The restraining clip as claimed in claim 4, wherein said first, second and third arms form a U-shape.

6. The restraining clip as claimed in claim 4, wherein said fourth arm is pivotally connected to said pivot block by a rivet.

* * * * *